United States Patent [19]

Silla

[11] Patent Number: 4,485,753

[45] Date of Patent: Dec. 4, 1984

[54] PROCESS AND APPARATUS FOR AUTOMATICALLY TRANSFERRING HOSIERY GARMENTS SUCH AS TIGHTS FROM A MACHINE

[75] Inventor: Vincente A. Silla, Castellon de la Pana, Spain

[73] Assignee: Solis S.r.l., Travarnuzze, Italy

[21] Appl. No.: 395,740

[22] Filed: Jul. 6, 1982

[30] Foreign Application Priority Data

Jul. 17, 1981 [ES] Spain ..... 504.416
Jul. 17, 1981 [ES] Spain ..... 504.417

[51] Int. Cl.[3] ..... D05B 21/00; D05B 97/00; D05B 3/12

[52] U.S. Cl. ..... 112/262.2; 112/121.15; 112/104

[58] Field of Search ..... 112/262.2, 262.3, 262.1, 112/121.15, 121.12, 2, 121.29; 223/43; 112/104

[56] References Cited

U.S. PATENT DOCUMENTS 4,220,104 9/1980 Humphreys ..... 112/121.15 X
4,364,320 12/1982 Nakhle et al. ..... 112/121.15 X

FOREIGN PATENT DOCUMENTS 462086 4/1978 Spain ..... 112/121.15

*Primary Examiner*—H. Hampton Hunter
*Attorney, Agent, or Firm*—McAulay, Fields, Fisher, Goldstein & Nissen

[57] ABSTRACT

Described is a process for transferring a hosiery garment formed with leg portions joined to a body portion and with a central opening to one end on which a patch is to be affixed, from a garment-making machine to a patch-sewing machine having garment support suction means, by the steps of: separating the leg portions of the garment while the garment is still on the garment-making machine; moving the body of the garment away from the garment-making machine; gripping and holding the garment by the opening; releasing the body and leg portions; widening the opening; removing the garment from the garment-making machine; displacing and rotating the garment until it is aligned with the support suction means; displacing the garment and disposing the opening on the support suction means of the patch sewing machine for sewing a patch thereon. Also disclosed is apparatus for carrying out the process comprising a pair of suction tubes to separate the leg portions, garment gripping means for gripping the garment through its opening which member has a ring member to surround the mouth of the tubular suction support means of a patch-making machine and means for transferring the garment gripping means to the support means.

11 Claims, 12 Drawing Figures

PROCESS AND APPARATUS FOR AUTOMATICALLY TRANSFERRING HOSIERY GARMENTS SUCH AS TIGHTS FROM A MACHINE

The invention relates to a process and a machine for automatically transferring garments, such as tights and pantyhose from a machine which produces tights with seams thereon to a machine which sews patches or gussets onto the tights or pantyhose.

It is known that the manufacture of two-piece panythose or tights with a patch or a gusset requires the formation of the body of such garments by joining two stockings or stocking legs, suitably cut and sewn by two straight seams in front and in back, leaving an opening in the center of the crotch zone, for a patch or gusset, and subsequently, the sewing of the patch onto the garment at opening. Traditionally, for transferring such garments from the machine on which they are made to that which sews the patches or gussets, diverse processes have been used, but all were manual because of the necessity to extract the garment from the machine, to transfer it to the gusset-sewing or patch-sewing machine, to cause the elastic deformation of the central opening where the patch is sewn, and to place the garment in the patch-sewing machine has made their automation very difficult.

OBJECT AND SUMMARY OF THE INVENTION

The object of the present invention has the object of achieving the complete is to automate fully the operations of extraction, transfer and placing of the pantyhose or tights from the machine which makes them to the machine which sews the patches.

The invention in its process aspects characterized by a series of operations to be effected on the garment in which previously the front and back seams have been sewn, leaving a central opening unsewn. These operations comprising the process of the invention include: separation of the two legs of the garment which is still on the garment-making machine; gripping the garment with lateral displacement; widening of the central opening intended to receive the gusset or the patch; transferring and rotation of the garment near the tubular support for the garment of the patch-sewing machine; and placing of the garment onto the base of the support.

In its apparatus aspect, the machine for carrying out this process comprises: means for separately gripping the legs and the body of the garment which is still on the garment-making machine; plier type means for widening the central opening intended for the gusset or patch and for supporting the garment through this opening; means for moving the pliers with the hanging garment around the garment support of the patch-sewing machine and placing the edge to be sewn with the patch onto the base of the support.

The advantages obtained owing to the invention consist essentially in that the manual intervention or operations reduced to a minimum; that the arrangement of the garment in the patch-sewing machine is consistently uniform; and that the output is very high; that the cost is substantially reduced.

Other objects, advantages and the nature of the invention will become readily apparent from the detailed description of the invention described in connection with the accompanying drawings.

DISCLOSURE OF BEST MODE OF THE INVENTION

Figure 1:
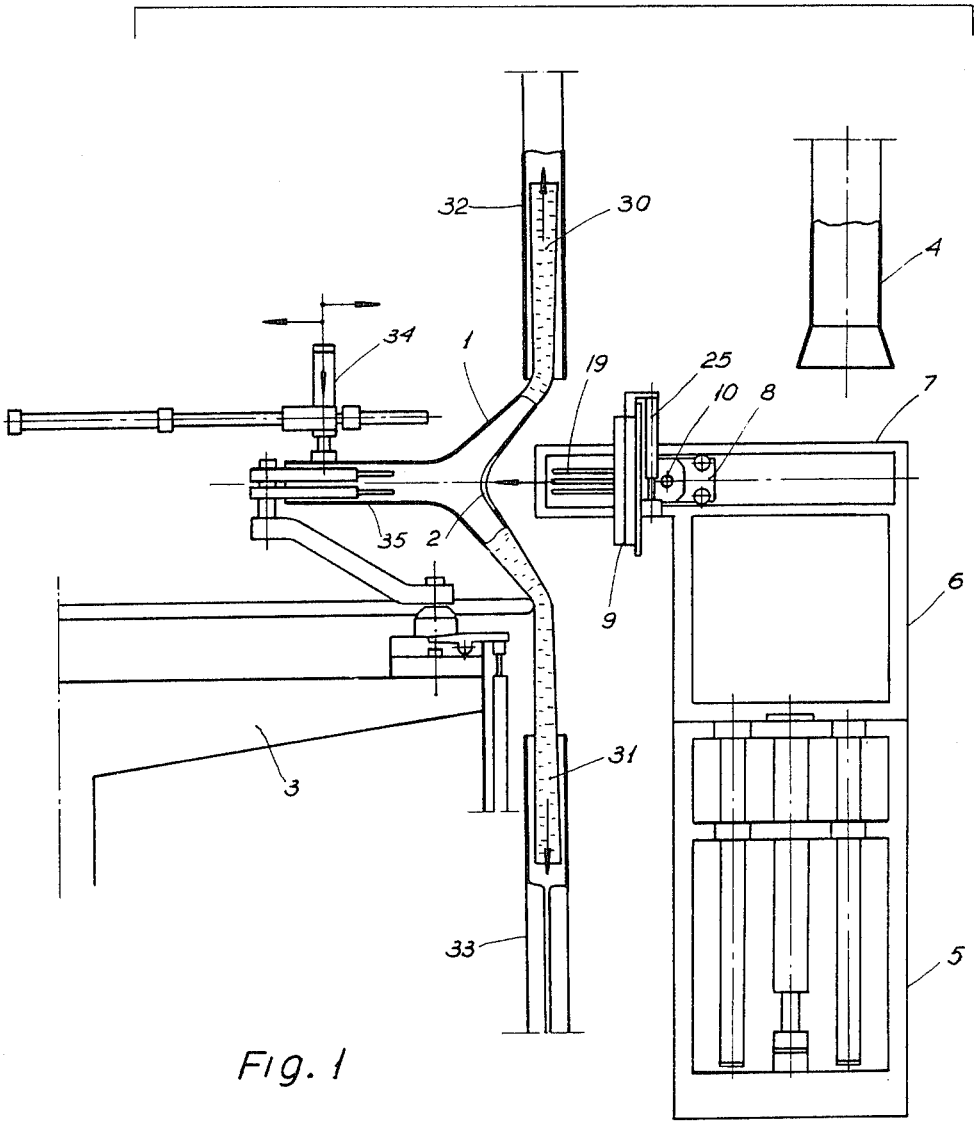
FIG. 1 is a party sectional view of the apparatus showing the separation of the legs (30–31) of the garment (1) by suction and the blocking of the body (35) while the gripping means (9) approaches the tight.
Figure 2:
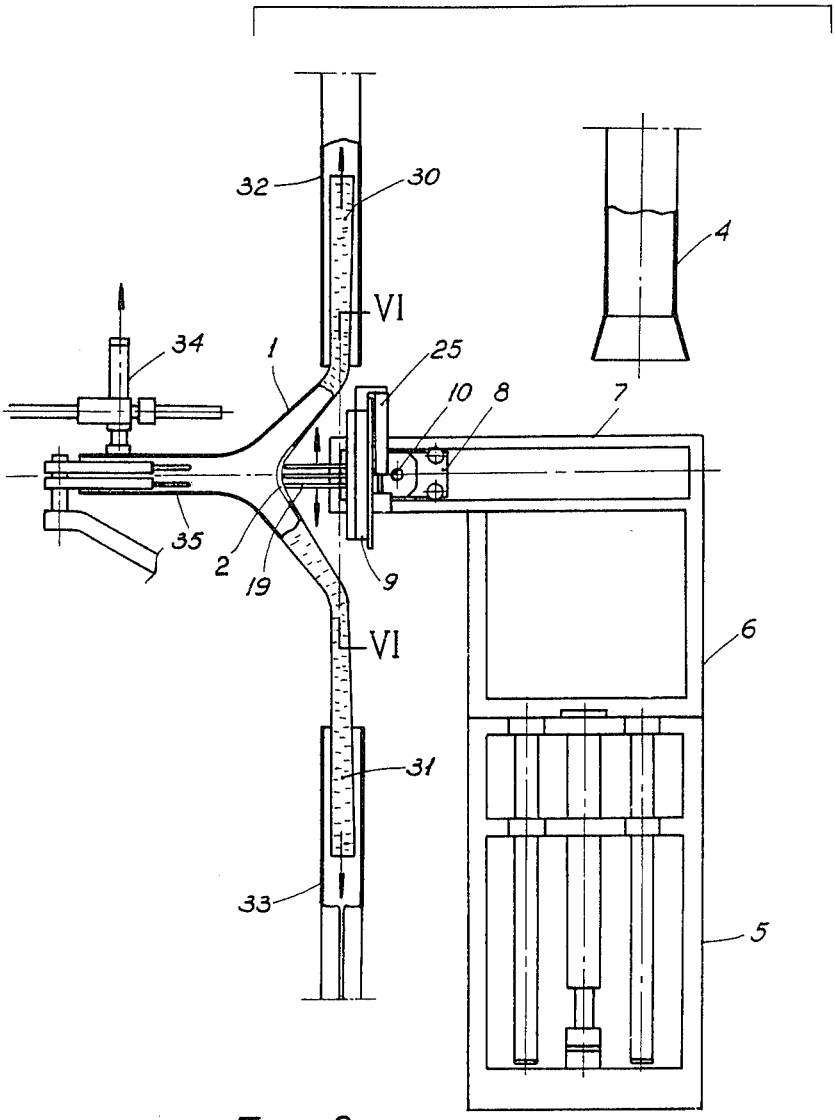
FIG. 2 is a view substantially the same as FIG. 1 but shows the gripping means (9) which are introduced into the opening (2) of the garment.

Referring descriptively to the drawings, the process of the present invention includes a first step in which the two legs of the garment are separated, manually, to facilitate the continuation of the fully automatic process which comprises:

Grasping by suction of the legs (30–31) in two separate but aligned vertical penumatic suction tubes (32–33), which gives access to the opening (2) for the patch; blocking of the body (35) of the garment on the garment-making machine (3) by means of a clamping foot (34) and the removal of the rest of the garment (1) from machine (3);

gripping garment (1) through its opening (2) by prongs (19) causing the widening thereof; the opening (2), from its initial oval form, assuming a substantially circular form which permits obtaining an elastic grip of the garment; such widening being obtained by radial displacement of the prongs (19);

release of the body (35) and of the legs by interruption of the suction in the tubes (32–33);

transfer with a 90° vertical rotation of the garment (1) held hanging from the prongs (19) through the opening (2) to its alignment, in underlying position, with the tubular garment support (4) of the patch-sewing machine;

raising of the prongs (19) with the hanging garment to a position with the edge (37) to be sewn at the patch around the end of support (4);

placing of edge (37) onto the base of said support (4);

lowering of the prongs (19) and their contraction.

The machine for carrying out the process of the present invention comprises:

A lifting member (5) which supports a group (6) consisting of horizontal guides (7), on which runs a carriage (8) and to which is connected a device (9) for the gripping, transport, and placing of the garment.

Figure 9:
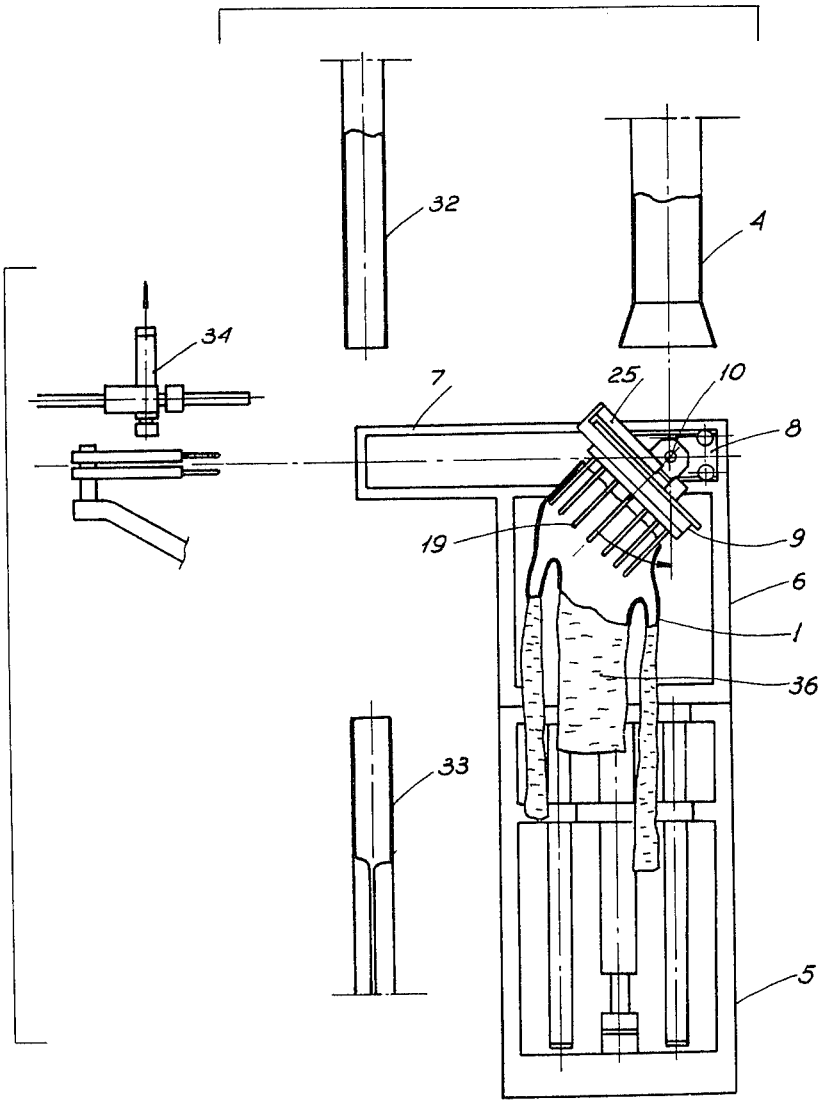
FIG. 9 is a partial sectional view showing the gripping means 9 with the hanging garment in the stage of transfer and of rotation.
Figure 10:
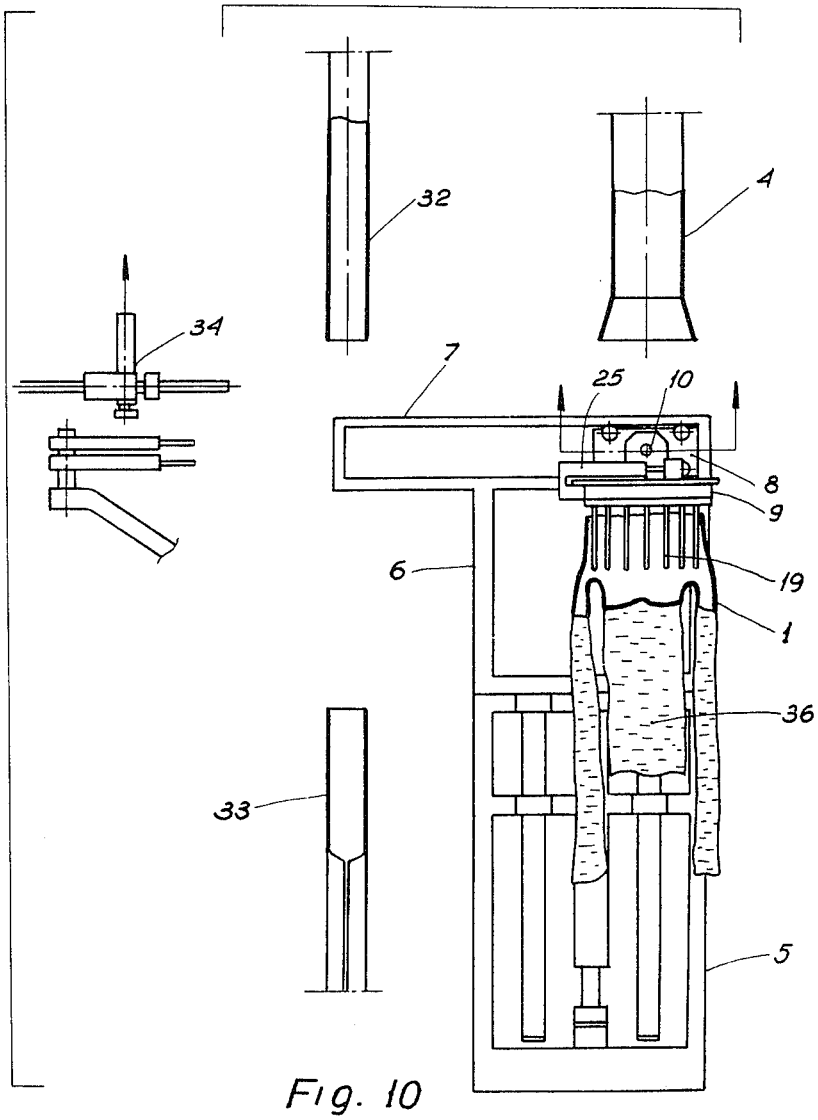
FIG. 10 is a partial sectional view showing the gripping means 9 in line under the garment support 4 of the patch-sewing machine.
Figure 11:
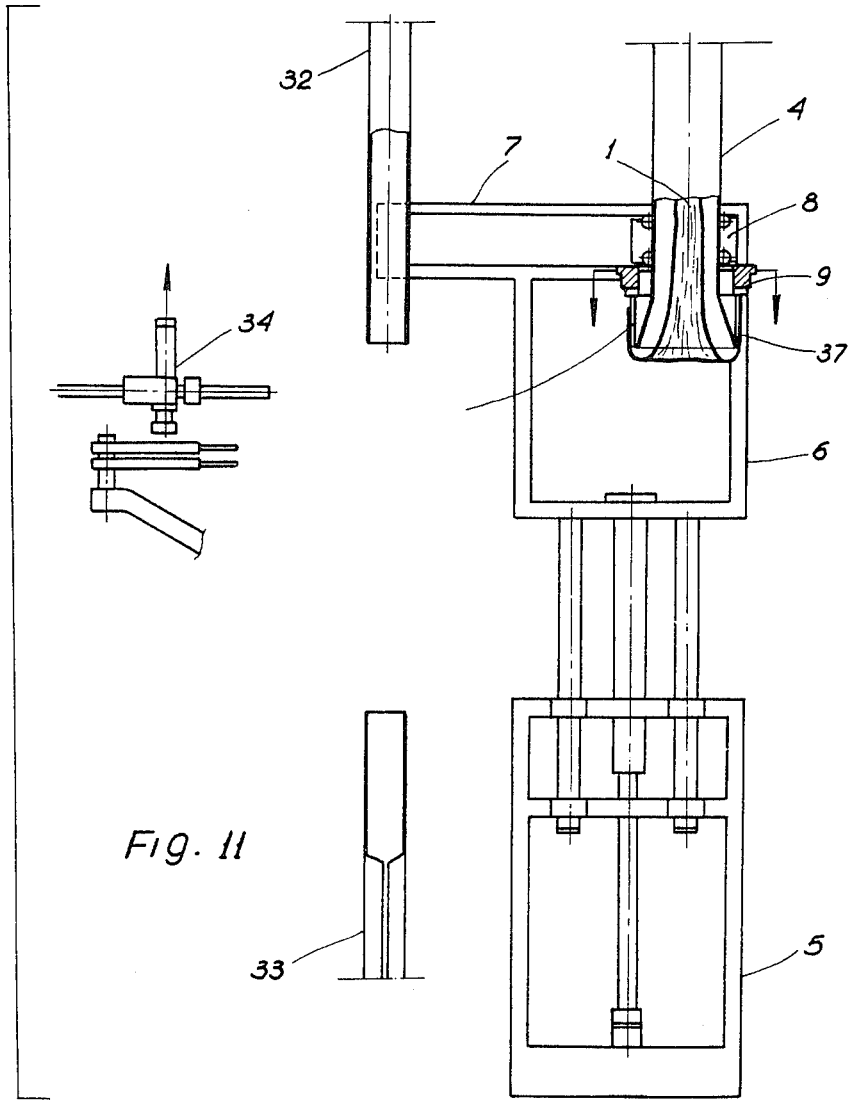
FIG. 11 is as FIG. 10 but shows the gripping means 9 around the base of the support 4 and with the garment 1 sucked into the interior of the support 4.
Figure 12:
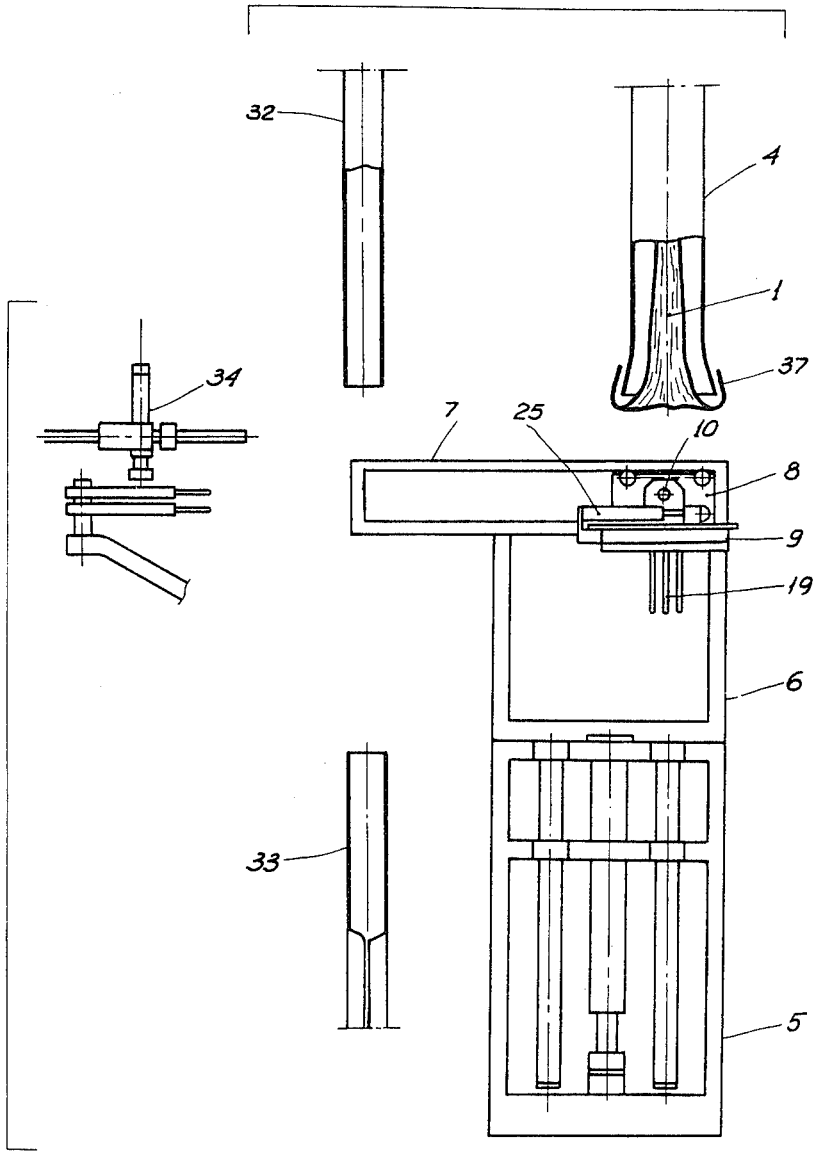
FIG. 12 is a partial view showing the gripping means 9 withdrawn from the support 4 and the garment with the edge 37 to be sewn at the patch, placed on the base of the suction support 4.

The device (9) is supported by a pin (10) integral with a crankshaft (11) which in turn is fastened to the end of the rod (12) of a cylinder (13); the advance of the rod (12) causes the rotation, in the direction of the arrow (14), of the shaft (11) and of the device (9) as is illustrated in FIG. 9 of the drawings.

The device 9 also includes a first movable outer ring (15) and a second fixed inner ring (16). The fixed ring (16) supports a plurality of curved sectors (17) carrying at their free end a prong (19) perpendicular to and integral with rivets (18) which, in turn, are fixed to corresponding plates (20) with holes (21) in which are housed a like number of pins (22) of the movable ring (15).

The ring (15) is fastened by means of a projection (23) to the stem (24) of a cylinder (25) which in turn is supported by the ring (16) by means of a strap (26).

Figure 3:
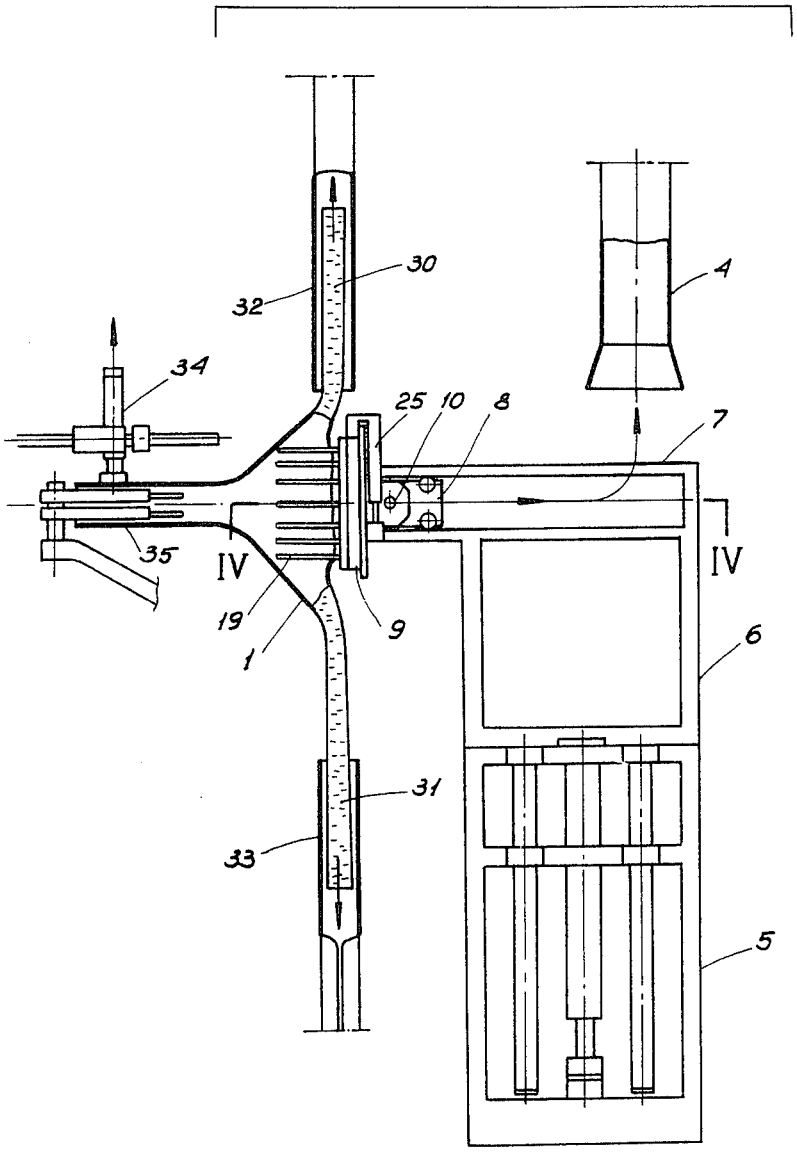
FIG. 3 is another view substantially the same as FIG. 1 but shows the elastic widening of the opening 20.
Figure 5:
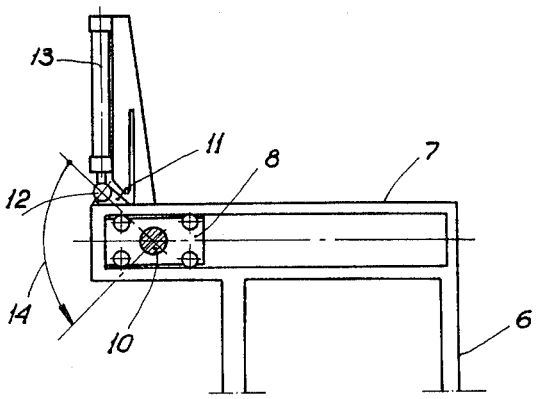
FIG. 5 is a cross section along V—V of FIG. 4.
Figure 6:
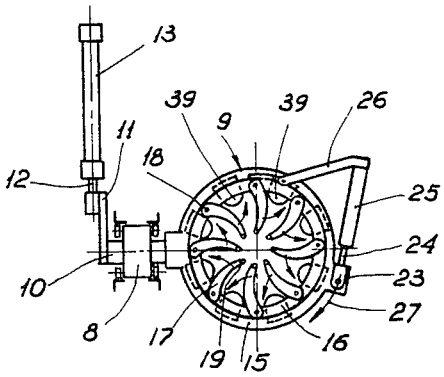
FIG. 6 is a cross section along VI—VI of FIG. 2.
Figure 4:
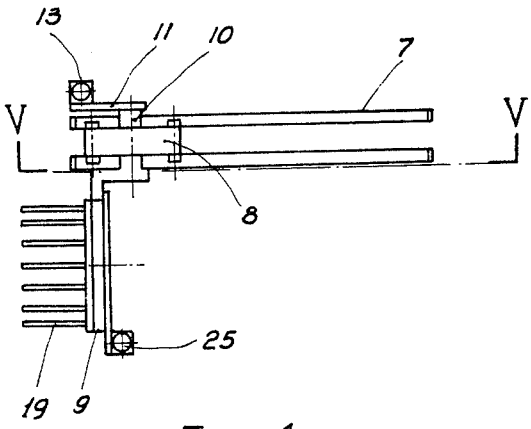
FIG. 4 is a cross section along IV—IV of FIG. 3.
Figure 8:
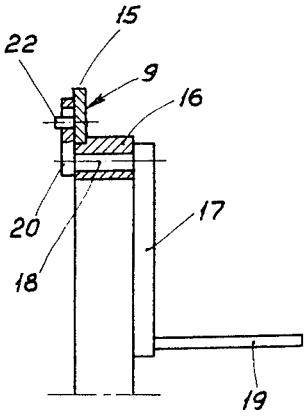
FIG. 8 shows the element of FIG. 7 in side view.
Figure 7:
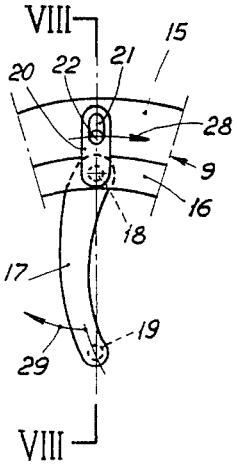
FIG. 7 is a plan view showing enlarged details of an element for radial expansion between those of FIG. 6.

The displacement of the rod (24) causes the rotation of the ring (15) in the direction of the arrow (27) and of the pins (22) in the direction of the arrow (28). This displacement forces the plates (20), with rivets (18) and sectors (17) with the prongs (19), to rotate in the direction of the arrow (29) so that the prongs (19), having been introduced into the opening (12), cause the widening of the edge of the opening and thereby exerting an elastic grip on the garment, as is illustrated in FIG. 3 of the annexed drawings.

The ring (16) is internally provided with several plates (39) of semi-elastic material such as rubber and the like.

The mode of operation is the following. Initially the legs (30–31) of the garment (1) are kept separated by suction in the tubes (32–33) and retain the body (35) on the garment-making machine (3) by means of the foot (34); then the carriage (8) is brought up to the garment to introduce the prongs (19) thereby exerting an elastic grip on the garment (1) through opening (2); subsequently, the body (35) having been released from the foot (34) and the legs (30–31) from the tubes (32–33), the carriage (8) is removed and to thus remove the garment (1) from the pantyhose making machine and to retain it hanging from the prongs (19); then the device (9) is rotated and transferred to an underlying position aligned with the support (4) of the patch-sewing machine; whereupon the device (9) is raised until the ring (16) surrounds support (4) and the edge (37) of the garment to be sewn at the patch is placed onto the base of the support (4) while the rest of the garment (1) is sucked into the interior of said support (4); lastly the device (9) is lowered and to bring the prongs (19) are brought together.

I claim:

1. A process for transferring a hosiery garment formed with leg portions joined to a body portion and with a crotch opening at one end on which a patch is to be affixed, from a garment-making machine to a patch-sewing machine having tubular garment support suction means, comprising the steps of:

separating said leg portions of said garment while said garment is still on said garment-making machine;

moving said body of said garment away from said garment-making machine;

gripping and holding said garment by said opening;

releasing said body and leg portions;

widening said opening;

removing said garment from said garment-making machine;

displacing and rotating said garment until same is aligned with said support suction means;

displacing said garment and disposing said opening on said support suction means of said patch sewing machine for sewing a patch thereon.

2. The process of claim 1, wherein said garment is held by said opening while said opening is widened.

3. The process of claim 1, wherein said garment is held radially.

4. The process of claim 1, wherein said separation is effected by suction.

5. The process of claim 1, wherein suction is interrupted before transfer and rotation of said garment.

6. The process of claim 1, wherein said opening is changed in shape from oval to substantially circular.

7. The process of claim 1, wherein said garment is a pantyhose.

8. Apparatus for transferring a hosiery garment formed with leg portions joined to a body portion and with a crotch opening at one end on which a patch is to be affixed, comprising:

a hoisery garment making machine;

a patch-sewing machine having a tubular suction support for holding said hosiery garment;

means for separating said leg portions and widening said crotch opening;

means for gripping and spreading said hosiery garment at said crotch opening;

said gripping means comprising a ring member adapted to surround the mouth of said tubular suction support means of said patch-sewing machine; and means for transferring said garment gripping and spreading means from said hosiery garment making machine to said sewing machine support means for placing the crotch opening over said support means.

9. The apparatus of claim 8, wherein said means for separating said leg portions comprises two vertical, spaced and aligned suction tubes each receiving therein one of said leg portions.

10. The apparatus of claim 8, wherein said garment gripping means comprise a plurality of circumferentially movable parallel prongs which positions said garment by centrifugal radial action on the edge of said opening.

11. Apparatus according to claim 8, wherein said garment gripping means comprise inner and outer concentric rings;

said outer ring being movable;

said inner ring being fixed and having a plurality of semi-elastic plates;

said plates carrying on one face thereof radially rotating sections;

one end of said sections having a perpendicular prong;

the other face of said plates having several plates connected to corresponding sectors and provided with a slot for seating a pin emerging from said outer ring.

* * * * *